US005706738A

United States Patent [19]

Rapeli

[11] Patent Number: 5,706,738

[45] Date of Patent: Jan. 13, 1998

[54] ADJUSTABLE PALLET FOR TRANSPORT

[76] Inventor: Pekka E. Rapeli, Martinlaaksontie 42 D 16, FIN-01620 Vantaa, Finland

[21] Appl. No.: 495,452

[22] PCT Filed: Jan. 25, 1994

[86] PCT No.: PCT/FI94/00033

§ 371 Date: Sep. 11, 1995

§ 102(e) Date: Sep. 11, 1995

[87] PCT Pub. No.: WO94/16938

PCT Pub. Date: Aug. 4, 1994

[30] Foreign Application Priority Data

Jan. 27, 1993 [FI] Finland ..... 930351

[51] Int. Cl.[6] ..... B65D 19/44

[52] U.S. Cl. ..... 108/54.1; 108/55.1

[58] Field of Search ..... 108/54.1, 55.1, 108/55.5, 51.1

[56] References Cited

U.S. PATENT DOCUMENTS

| | | | |
|---|---|---|---|
| 622,666 | 4/1899 | Burwell | 108/54.1 X |
| 1,317,550 | 9/1919 | Cass | 108/54.1 X |
| 2,377,911 | 6/1945 | Warren | 108/54.1 |
| 2,405,535 | 8/1946 | Weiss | 108/54.1 |
| 2,764,377 | 9/1956 | Sccgoenecker | 108/54.1 |
| 2,909,350 | 1/1959 | Morris . | |
| 2,942,827 | 6/1960 | Edson | 108/54.1 |
| 3,251,321 | 5/1966 | Budd | 108/54.1 |
| 3,363,597 | 1/1968 | Zeien . | |
| 3,703,870 | 11/1972 | Walton | 108/51.1 X |
| 3,791,314 | 2/1974 | Box | 108/51.1 X |
| 3,977,333 | 8/1976 | Phillips . | |
| 4,240,359 | 12/1980 | Howe | 108/55.1 X |
| 4,922,834 | 5/1990 | Kraus | 108/51.1 |
| 5,092,541 | 3/1992 | Tofflemire et al. . | |
| 5,233,931 | 8/1993 | McCorkle, Jr. | 108/55.1 |

FOREIGN PATENT DOCUMENTS

| | | | |
|---|---|---|---|
| 0 452726A1 | 3/1991 | European Pat. Off. . | |
| 0 528185A1 | 7/1992 | European Pat. Off. . | |
| 1 038 482 | 9/1958 | Germany . | |
| 1 178 733 | 9/1964 | Germany . | |
| 377281 | 6/1964 | Switzerland . | |
| 619392 | 8/1978 | U.S.S.R. | 108/54.1 |
| WO87105581 | 9/1987 | WIPO . | |

OTHER PUBLICATIONS

Concise English–language translation of German–language Patent Document 1 178 733.

Concise English–language translation of German–language Patent Document 1 038 482.

Concise English–language translation of German–language Swiss Patent Document 377281.

*Primary Examiner*—Jose V. Chen

*Attorney, Agent, or Firm*—Klarquist Sparkman Campbell Leigh & Whinston, LLP

[57] ABSTRACT

An adjustable pallet for transporting cargo, particularly automobiles, comprises an extension member adjustably attached to a rectangular base with the extension member and base each having a loading surface capable of supporting cargo thereupon and defining the total loading surface of the pallet. The extension member has a retracted position and an extended position relative to the base with the extension loading surface of the member being substantially co-planar with the base loading surface in the retracted position and the extended position. The extension member may be attached to the base by rails extending from one of the base and extension member and the other of the base and extension member having channels defined therein to slidably receive the rails, such that the extension member is slidably extendable from the base to form a selectively variable total loading surface. A plate fixedly attached to the extension member provides a substantially continuous total support surface from the base to the extension member in a range of positions of the extension member relative to the base. Alternatively, the extension member may be pivotally attached to the base such that the extension member may be retracted within the base or fully extended from the base. The adjustability of the pallet combined with its ability to support heavy objects makes it particularly well adapted for use in transporting vehicles.

18 Claims, 4 Drawing Sheets

ADJUSTABLE PALLET FOR TRANSPORT

Figure 1:
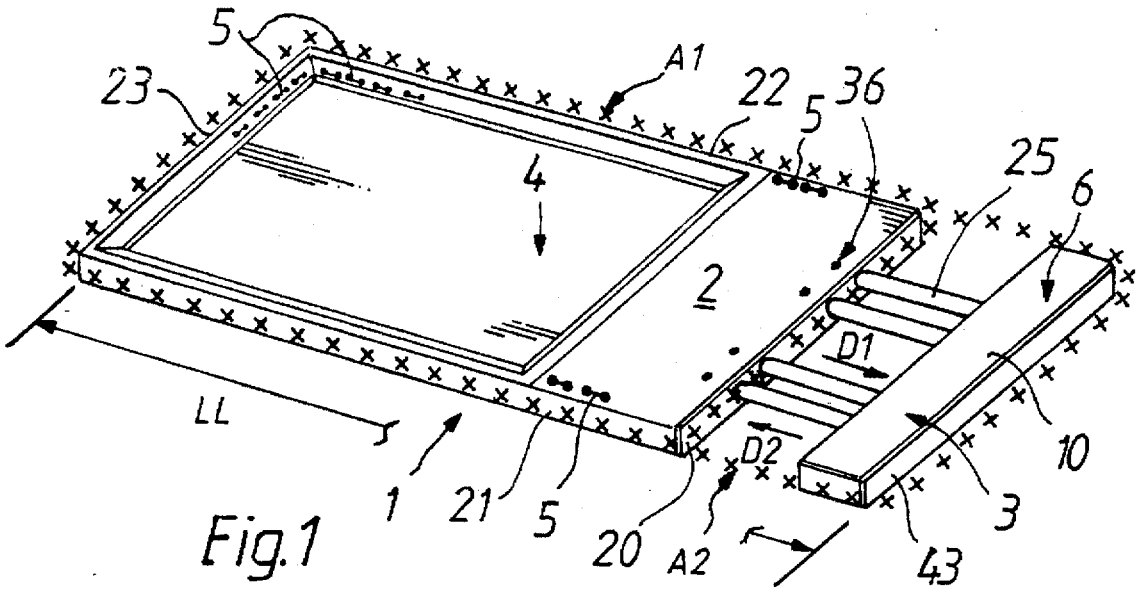

The present invention relates to a general goods transport pallet, comprising mainly a rectangular and flat base with fixed dimensions, whereupon the general goods to be transported have been positioned and which is provided with locking members for locking said general goods to the pallet during transportation, and extension pieces extending exterior to the base and rigidly fastenable thereto, for enlarging the loading surface area of the transport pallet if needed. The invention also relates to use of said transport pallet for transporting cars and other wheeled vehicles.

Transport pallets in themselves have long been constructed in various configurations. The basic structure of a transport pallet is described in publication U.S. Pat. No. 26164. Since provision of good strength in a transport pallet and reduction of the thickness increases transport payload capacity, a plurality of different shapes have been set forth regarding the structure of transport pallet. For instance, in publication U.S. Pat. No. 3,709,161, a transport pallet of cell structure is described. In publications GB-2,182,703 and U.S. Pat. No. 4,801,483, different types of plate constructions are described, such as sandwich plates which would be appropriate for use, for instance, in producing pallets although said publications do not actually concern pallets. In addition, the pallets are provided with fastening members for fastening a load to be placed on top of pallet to said pallet. Said fastening members are described in publications U.S. Pat. No. 3,622,114 and U.S. Pat. No. 4,834,000. In the latter publication, a pallet design is described where one of the ends is provided with rolls, so that by inclining the pallet it can be pulled while the pallet is moving supported by the rolls rolling at said end. Said prior art designs known are encumbered with the drawback that the pallet is always fixed in dimensions, whereby transporting such products is completely impossible in which a dimension exceeds, even slightly, the length or width of the pallet. This is due to the fact that during transportation or storage, the pallets are always arranged tightly next to one another in order to prevent them from moving, whereby placing an article of excessive dimensions on a pallet would harm this, in addition to which, if a loading is carried out without paying any attention to this factor, the forces during the transportation are directly directed at the general goods being transported, which would very likely cause damages in said goods during transportation or stowage, or other forms of transfer.

Publication U.S. Pat. No. 5,092,541 describes a transport pallet, comprising mainly a rectangular and flat base fixed in dimensions, just like any other pallet. The pallet contains furthermore the standard fastening members for fastening the general goods to be placed thereupon. Differing from the rest of the transport pallets, the pallet structure of said publication contains typically two extension pieces mounted on the opposite edges of the pallet, thus increasing the loading surface area of the pallet. The extension pieces of the reference publication are in cross-section of the shape of a reverse letter L, one branch whereof being inserted into the fastening holes in the pallet edge, so that the other branch of the L shape projects outwards from the pallet. Said extension pieces are locked in place from an upper L-shaped branch with side rods or side wires reaching the fastening holes of the other sides of the pallet. In the present structure, the aim has particularly been to increase the payload effectiveness of an aeroplane, the hull whereof being round in cross-section, so that the loading surface divided into two different heights is particularly well appropriate inside the aeroplane in the lower parts thereof when the extensions are transverse to the length of the plane. As regards other usages, said structure is encumbered with serious drawbacks. First, just the fact that the loading surface has with extensions been divided into two different heights, prevents loading of various types of general goods, which would require that the entire loading surface is always on one plane. For instance, cars could in no case be loaded on an extended transport pallet of the structure as the one described in the present reference. The locking of the extensions onto the base of the pallet is such in the reference publication arrangement that the pallets have to be loaded next to one another with the sides against each other which have no extensions. This is due to the fact the extension pieces give in if pushed at the projecting branches from outside towards the middle parts of the pallet, which would cause damaging of loaded goods. The third drawback is that the extension pieces are loose pieces, whereby there should be everywhere such pieces in locations where a load is positioned on a pallet, or it should be possible to have these be left in places like these because extensions like these are not required by all loads. This causes considerable difficulties in arrangements, and additional costs. The fourth drawback is that the extensions are standard in dimensions, whereby the only alternatives comprise a pallet without an extension, or a pallet provided with extensions of fixed dimensions, no intermediate modes can be used.

Therefore, the primary objective of the present invention is to provide a transport pallet for general goods, which would be provided with such extension parts with which the loading surface area of the pallet can, if needed, be enlarged by maintaining the loading surface area at least approximately and substantially in one plane. The second aim of the invention includes extensions like these with which the loading surface area of the pallet can be enlarged and reduced steplessly, and which extension parts are particularly non-yielding without yielding against all forces in the course of loadings, stowage, transfers and transports. Therefore, the aim is to provide transport pallets which can be positioned next to one another with any of the sides against each other, e.g. an extension against another extension. One more aim of the invention is this kind of transport pallet in which the extension parts constitute a fixed part of the pallet construction so that they are always included in said pallet and can thus be taken into use and out of use anywhere without storage of additional parts and without any costs caused therethrough. The aim of the invention is furthermore this kind of transport pallet which would be particularly appropriate for transporting cars or other wheeled vehicles, or equivalent articles so that said articles have always been positioned within a rectangular prism defined by the outline of said transport pallet, advantageously only just within said prism, and the loading surface area defined by the contour of said pallet is capable to withstand, without any deformations, as described above, all loadings potentially directed thereon. The transport pallet according to the above aim is required to be non-costly in price, and the changing of the loading surface area must be made easy.

The drawbacks described above can be eliminated and the objectives determined above are achieved by means of a transport pallet according to the present invention, which is characterized in what is determined in the characteristic features' part of claim 1. The use of a transport pallet according to the invention is in turn characterized in what is determined in the characteristic features' part of claim 15.

One of the most significant advantages of the invention is that in a transport pallet according to the invention the loading surface area is always kept essentially in one plane, whereby any type of load can be placed thereon. With a transport pallet according to the invention, the loading can be carried out highly space-savingly because the transport pallet is adjustable, and preferably steplessly adjustable at least in one direction. Another advantage of the transport pallet of the invention lies therein that it withstands any forces coming from various directions, so that the pallets can be loaded in any position next to one another or they can be handled in any position so that no forces are directed at the load on the pallet. By appropriate dimensioning of the transport pallet of the invention and by providing the internal construction thereof appropriate, pallets of varying thicknesses and various strength constructions are achieved, which are well suited for highly different usages in which the distances of the points supporting the pallet from one another and the magnitude of the load may vary considerably.

The invention is described below in detail, referring to the accompanying drawings.

FIG. 1 presents axonometrically a preferred embodiment of transport pallet according to the invention.

Figure 2A:
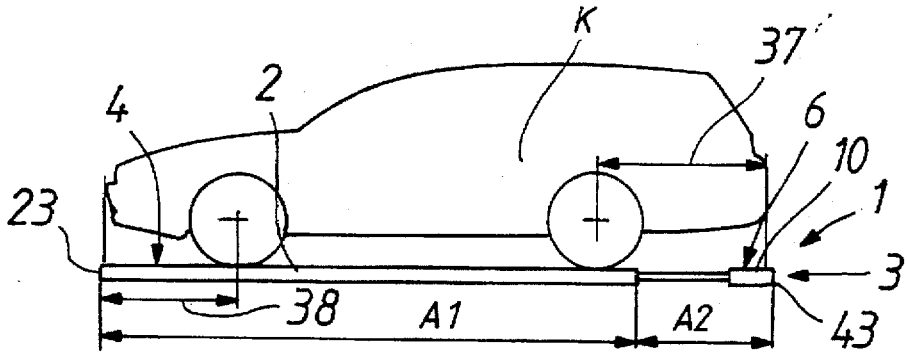
Figure 3B:
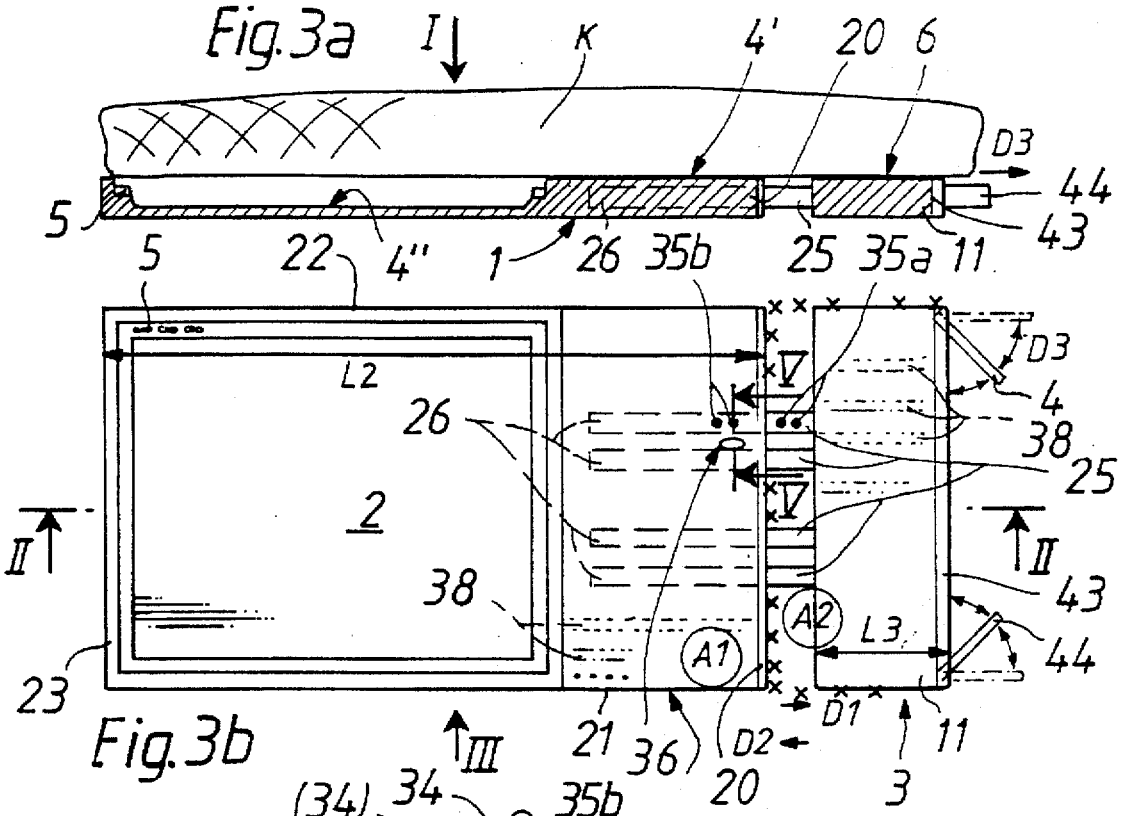
Figure 7A:
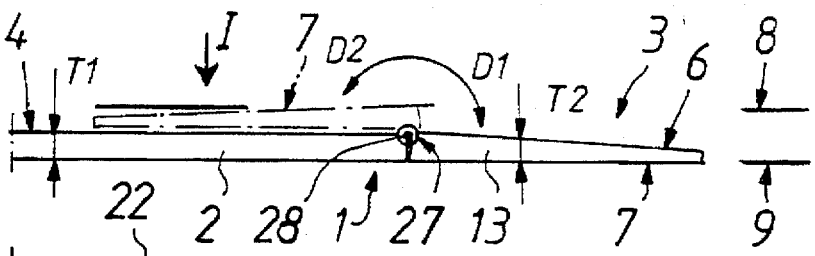
Figure 7B:
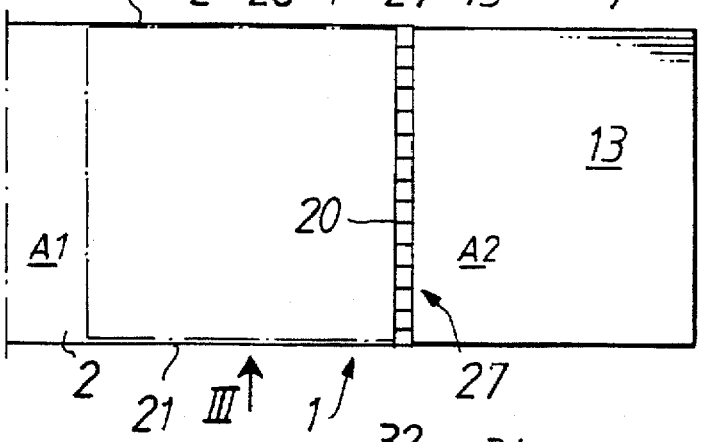
Figure 8A:
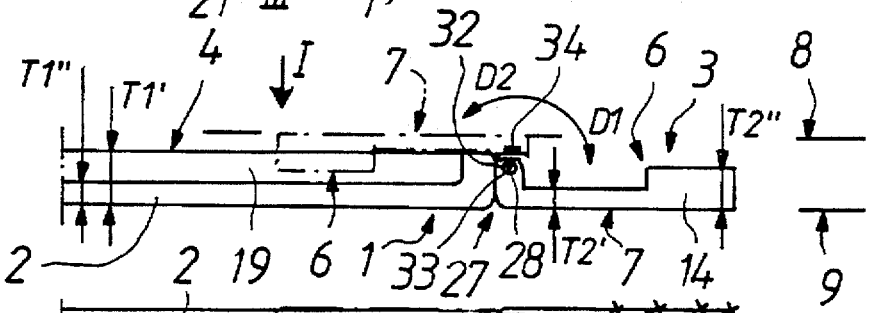
Figure 8B:
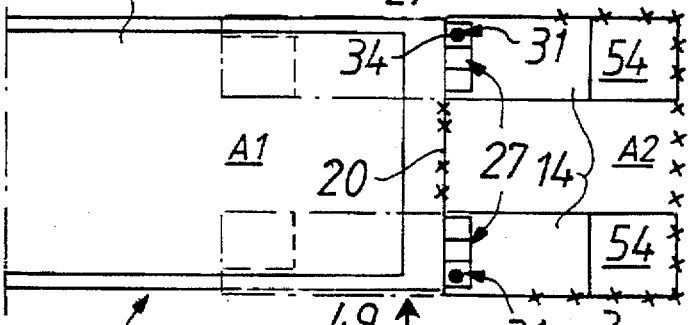

FIG. 2A presents a car placed on a transport pallet according to FIG. 1 as a transportable unit load in elevational view in the same direction as direction III in FIGS. 3B, 7B and 8B.

Figure 2B:
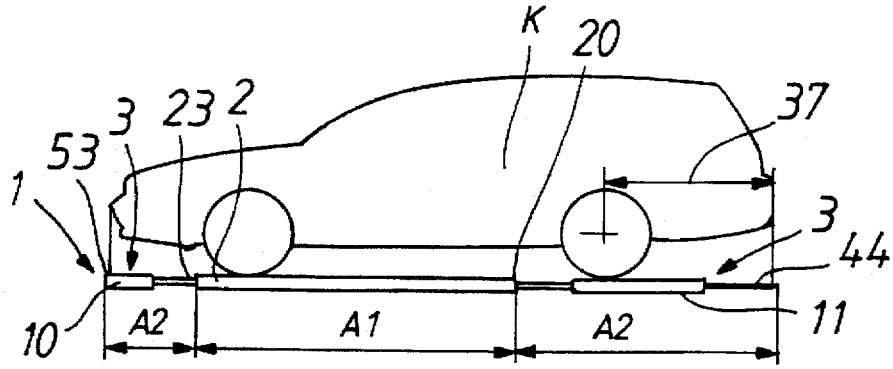

FIG. 2B presents a car placed on a transport pallet of another embodiment in elevational view in the same direction as in FIG. 2A.

FIG. 3A presents a third embodiment of the transport pallet of the invention in elevational view as a section along plane II—II of FIG. 3B.

FIG. 3B presents in top view the transport pallet of FIG. 3A in direction I.

Figure 4:
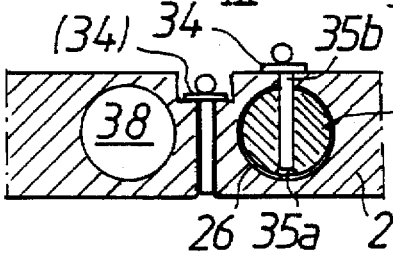

FIG. 4 presents a detail of the locking of an extension piece as a section along plane V—V of FIG. 3B.

Figure 5:
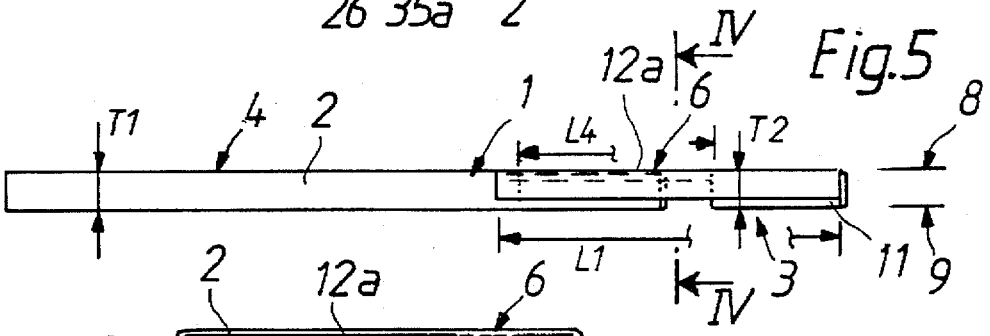

FIG. 5 presents a fourth embodiment of the transport pallet of the invention in side view in the same direction as in FIGS. 2A, 2B and 3A.

Figure 6A:
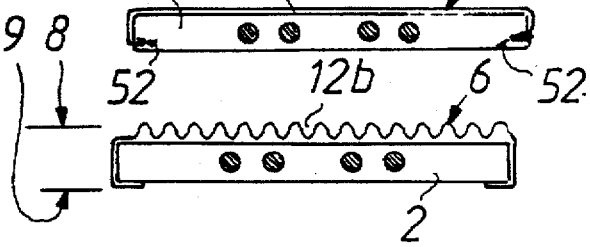

FIG. 6A presents a detail of the structure of FIG. 5 as a cross-section along the plane thereof IV—IV.

Figure 6B:
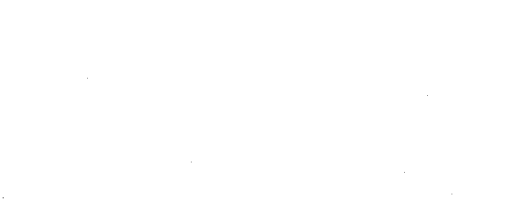

FIG. 6B presents a second embodiment of said detail in same image as FIG. 6A.

FIG. 7A a fifth embodiment of the transport pallet of the invention in elevational view in direction III of FIG. 7B.

FIG. 7B shows the structure of FIG. 7A in top view in direction I.

FIG. 8A presents a sixth embodiment of a transport pallet of the invention in elevational view in direction III of FIG. 8B.

FIG. 8B presents the transport pallet of FIG. 8A in direction I.

Figure 9:
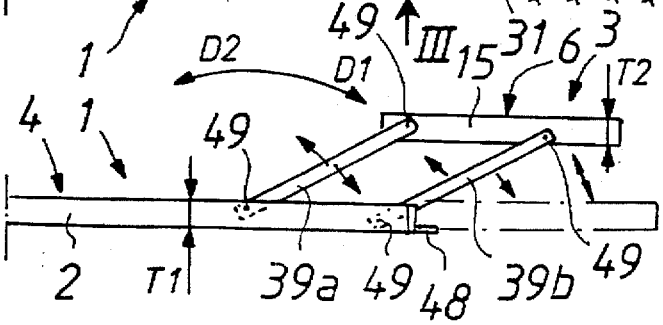

FIG. 9 presents the seventh embodiment of a transport pallet of the invention in the same image as in FIGS. 2A, 2B, 3A, 5, 7A and 8A.

Figure 10:
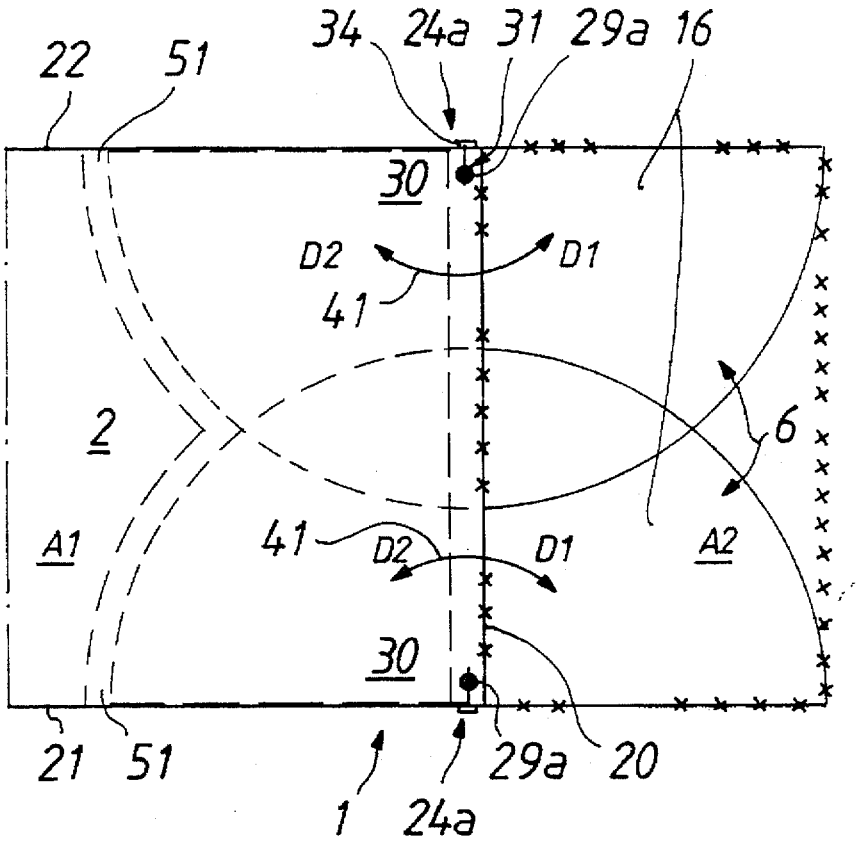

FIG. 10 presents an eighth embodiment of the transport pallet of the invention in top view as in image of FIGS. 3B, 7B and 8B.

Figure 11:
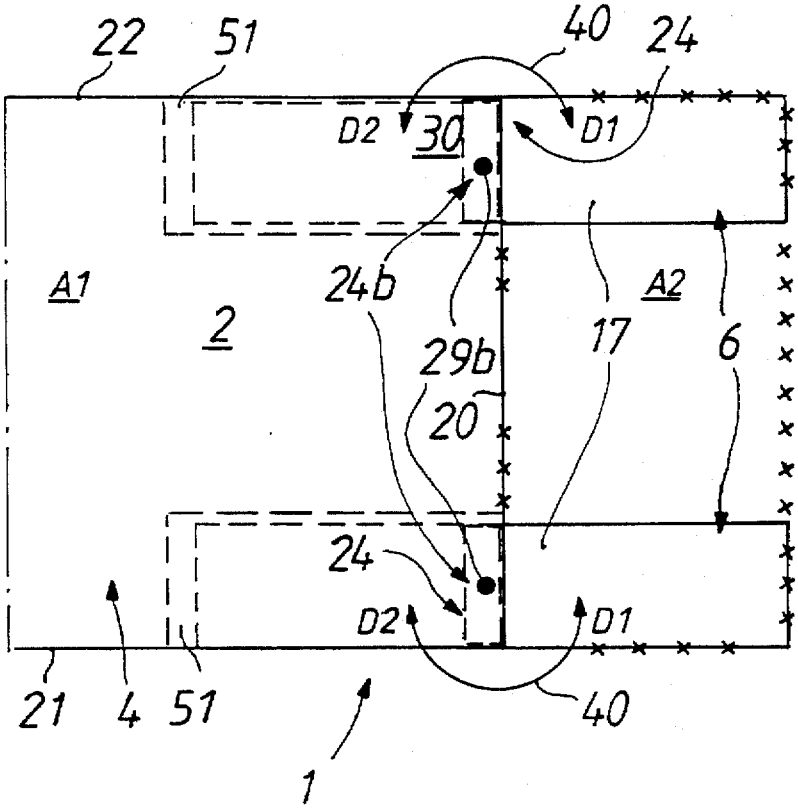

FIG. 11 presents a ninth embodiment of the transport pallet of the invention in the same image as in FIG. 10.

The figures present a transport pallet 1 for general cargo, comprising first a rectangular and flat base 2 of fixed dimensions. The thickness of the base T1 is remarkably small compared for instance with the length L2 of said base in the longitudinal direction LL of the entire transport pallet. In FIGS. 2A and 2B the length of the base 2 is marked in a way with reference A1, illustrating actually the loading surface area of the base 2, the length L2 being one of the components thereof. In addition, the transport pallet 1 of the invention comprises extension pieces, or members 3 with which the loading surface area of the transport pallet is enlarged by moving the extension piece from a retracted position to an extended position. At least the base 2 is provided with fastening members 5 for locking the general goods K placed on the transport pallet 1 in place during the transport. Said fastening members 5 can be any known type appropriate for use in said purpose, so that they are not described in detail. If need be, fastening members may also be provided on the extensions 3.

As taught by the invention, the extension pieces 3 are mainly composed of planar components 10 through 17, the thickness T2 thereof in a direction rectangular against the loading surface 4 of the base being at most slightly greater than but in the main, advantageously the same as or smaller than the thickness T1 of the base 2 in the same direction, as can be seen in the figures. Said extension pieces can be moved close to the base 2 or thereinto, or thereon in a manner described below more closely, and, if needed, transferrable outwards for enlarging the loading surface area of the transport pallet. In the most preferred embodiments, the extension pieces 3 are steplessly transferrable, whereby the fixed loading surface area A1 defined by the base 2 can be enlarged steplessly, with the result that the loading surface area A1+A2 defined by the base 2 and the extensions 3 together can every time be adjusted as desired. In addition, in a base of the invention extension pieces 3 are included in the transport pallet 1 as permanent components, and the surface 6 or 7 thereof facing the load is located between the planes 8 and 9 defining the upper and lower surface of the transport pallet, whether the extension pieces 3 are in an outward-moved position, in which they enlarge the loading surface area of the base, or in a position pulled inwards, in which the loading surface area is smallest. According to the invention, the distance between the upper surface 8 and the lower surface 9 of a transport pallet is at most T1+T2, this being in general, as described above, slightly more than 2*T1 (e.g. embodiment in FIGS. 7A and 7B), but in the preferred embodiments substantially less than 2*T1 (e.g. embodiment in FIGS. 8A and 8B), or approaching T1 (e.g. embodiments in FIGS. 5 and 6A, 6B. In the best embodiments the distance between the upper surface 8 and the lower surface 9 is the same as the thickness T1 of the base and the same as the thickness T2 of the extension (for instance, FIGS. 1, 2A, 2B, 3A, 3B, and 9 through 11). It is noted in the present context that as a matter of fact, the total loading surface area A1+A2 varies, being dependent on the position in which the extensions are, even if the loading surface area A1 of base 2 is constant and is dependent on the construction in each case. Increase A2 of the loading surface area provided by the extension piece consists of the surface area of the extension itself and the extraction D1 between the extension 3 and the base 2. In FIG. 1, the surface areas A1 and A2 are indicated by broken lines, and in FIGS. 3B, 10, 11, parts of the outline of the loading surface area A2 composed of the extension, with a ticked line, for clarification.

FIGS. 1 and 2A show one of the simplest transport pallets of the invention. Here, the transport pallet comprises a rectangular base 2 as the extension 3, and on one of the edges thereof, i.e. on the leading edge 20, a transverse part 10 in the same direction and approximately of the length of said edge, the loading surface area of said transverse part being adjusted on about the level of the loading surface area 4 of the base. Said transverse part 10 is provided with flexurably rigid and preferably fixed rails 25 and channels extending from said first edge 20 of the base towards the centreparts thereof in parallel with the loading surface 4, into which channels said rails 25 enter and in which they are able to glide. Therefore, the transverse part 10 can be carried inwards in direction D2 to a point in which the transverse part 10 touches the base 2, so that the loading surface area A1+A2 is at minimum. The loading surfaces 4, resp. 6, of the base and the transverse part are substantially in the same plane, as shown clearly in FIG. 2A. When the transverse part 10 is moved outwards as long as allowed by the rails 25, the loading surface area A1+A2 is maximal. The areas A1 and A2 demonstrating the loading surface area and sections thereof can be seen in FIG. 1 and FIG. 2. In this case, the loading surface area A1+A2 is steplessly adjustable according to the pull-out extent of the transverse part 10. The transverse part 10 constituting the extension piece 3 in the present instance is locked into a desired position at each moment with a locking member 36, the structure thereof being described below.

FIG. 2A demonstrates the use of the pallet as in FIG. 1 for transporting a car, being here the general cargo K to be transported. In the present instance the foremost and rearmost wheel pairs of the car K have been disposed on the base 2 so that the front exceeding 38 of the car keeps the front end of the car from the vertical plane depicted from the base edge 23 of the base to stand on the side of the base, and accordingly, within the loading surface area A1+A2, while the rear-end exceeding of the car is so attended to that the transverse part 10 is pulled as far backwards in direction D1 as possible, that the vertical plane depicted from the outer edge 43 thereof leaves the rear-end of the car within the loading surface area A1+A2 of the transport pallet. In a usage like this, the transverse part can be very short in the longitudinal direction LL of the transport pallet, as shown in the figure. In the present instance, if the bend resistant rails 25 are substantially of the length of length L2 of the base 2, the total length LL of the transport pallet can be changed in ratio 1:2. However, a partial empty space between the base and the transverse space left there by the rails may in some loading cases make the use of this structure more difficult.

FIGS. 2B, 3A and 3B show a slightly modified structure compared with that presented above. Here, the extension 3 consists of a transverse part 11, the length L3 in the longitudinal direction LL of the pallet being substantially longer than in the preceding case. Hereby, for instance the foremost wheel pair of a car can be placed on the base, as shown in FIG. 2B, and the rearmost wheel pair on the extracted D1 transverse part 11. Also here, the loading surface 4 of the base and the loading surface 6 of the transverse part 11 are in the same plane. The transverse part 11 and the base 2 have been likewise connected with rails 25 gliding in the response channels 26 of the base, whereby transferring the transverse part 11 outwards in direction D1 enlarges the loading surface area A1+A2, and transferring it inwards D2 to touch the base or close to the base reduces the loading surface area A1+A2 of the transport pallet. The length L3 of the transverse part 10 or 11 can be increased from the one presented in the figures even to the extent that the length L2 of the base and the length L3 of the transverse part are equal. Increasing the length of the transverse part even more therebeyond will give an inverse meaning to words "extension" and "base", if the base is assumed to be larger of the two. If the length L3 of the transverse part is considerable and the rails therein are fixed, the length L2 of the base determines the possible size of the transfer D1 out. If response channels 26 are arranged both on the base 2 and the transverse part 10 or 11, and rails 25 therefor, the length L4 thereof being equal to the lengths L2 and L3 of the base and the transverse part put together, i.e. L4=L2+L3, and both the base and the transverse part are moved relative to the rails, also in said dimensioning alternative, the loading surface area can be changed in ratio 1:2 by means of extraction. It is obvious that in the embodiments of FIGS. 1 through 6B described above the rails 25 can be rods, pipes or various profiles, which have been preferredly formulated to be such that their rigidity against the loading planes 4,6 in rectangular direction is good and the weight small. Also guide arrangements of other kind, such as telescopic structures, can be used. To have the extraction of the extension piece with said members great is easy, whereas provision of sufficient rigidity is difficult.

Extension pieces 3 of a transport pallet 1 of the invention can be arranged, not only in the manner described above, on one edge 20 of the base 2, but also advantageously on two opposite edges 20 23, whereby said extension pieces can be mutually similar or dissimilar. FIG. 2B shows one embodiment like that in which on a first edge 20 of the base 2 a transverse part 11 quite large in length L3 described above has been arranged, and on the opposite edge 23 thereof, a transverse part 10 has been arranged, being minor in length and of the type described above. In addition, the arrangement of FIG. 2B as well as the transport pallet shown in FIGS. 3A and 3B includes protective cantilever brackets 44, so that the total length LL defined by the base 2, the extension pieces 3 and the cantilever brackets 44 forms the entire loading surface area A2+A1+A2. Said protective cantilever brackets 44 have in the present instance been positioned on the edge 43 of the transverse part 11 which points outwards from the base 2. Said protective cantilever brackets 44 can in this case be converted in directions D3 to be aligned with edge 43 or at right angles thereto, as depicted in FIG. 3B by broken line. The intact line presents the intermediate position of the protective cantilever brackets. Said protective cantilever brackets are not normally bearing the forces directed rectangularly at the loading planes 4 and 6, such as the extension pieces 10 through 17 in some embodiments and usages, instead, they are used merely in receiving the forces in the direction of the loading planes 4, 6 of the transport pallet 1 during transportation and other forms of transfer. As can be seen in FIG. 3B, the position of the protective cantilever brackets 44 can be adjusted as needed. It is clear that the protective cantilever brackets 44 may differ in structure from the pivot shafts described above. For instance, the protective cantilever brackets can be telescopic rods and provided with a bar therebetween, or be of another structure. In the instance shown in FIG. 2B, the rearmost edge of the transport pallet can be extended with the protective cantilever brackets 44 further of than the rear edge of car K being transported as unit cargo, whereby e.g. the leading edge of the transport pallet 1 of a car being loaded next aboard on the ship can be pushed very close to said protective cantilever brackets without making the cars touch one another.

FIGS. 5 and 6A, 6B present a structure with which the above described harmful effects of the gap between the base 2 and the extension piece 3, such as transverse part 10 or 11, can be eliminated if needed. The figures present a relatively thin surface plate 12 pointing towards the base 2 and mounted on the transverse part 10, 11, said plate being located on the loading surface 6 of the transverse part, the length L1 thereof being typically at least of the length L4 of the rails 25 when the rails 25 are fixed on the transverse part 10, 11. Said surface plate 12 glides along the loading surface 4 of the base when the transverse part is inserted in direction D2 and pulled out in direction D1, whereby the loading surface area A1+A2 of the transport pallet remains without any gaps because the surface plate 12 extends from the top of the transverse part onto the base, while being substantially in the same plane as the loading surfaces 6 and 4 of both of them. FIGS. 6A and 6B present two different embodiments of surface plate 12, i.e. surface plates 12*a* and 12*b*. The surface plate 12*a* is an even plate in the region of the loading surfaces 4, 6, such as steel plate, whereby the loading surfaces 4 and 6 can be maintained very precisely same in height 8. FIG. 6B presents a different surface plate 12*b*, being made from a plate corrugated on the top surface, so that the plane 8 defining the upper surface of the transport pallet is slightly higher in said point than for instance in other parts of the base where it is produced from the loading surface 4 proper. However, such configuration is well useful in instances in which there may be even a long gap between the base 2 and the extension 3, whereon great loads may be positioned. The advantageous opportunity is actually due to the fact that this kind of corrugated plate is more rigid. In the instance of FIG. 6A the edges of the surface plate 12 have been linked into the grooves 52 existing in the edges 21 and 22 of the base which are perpendicular to the leading edge 20 by shaping the edges of the surface plate groove-like. In embodiment in FIG. 6B the edges of the surface plate 12 have been turned onto the undersurface 9 of the base 2 to form a groove around said edges 21, 22.

FIG. 9 presents a transport pallet of the invention which distinctly differs from the constructions described above, in which the extension pieces 3 comprise at least on one edge of the base a transverse part 15 in parallel with said first edge 20 and approximately of the length thereof. Said transverse part 15 has been linked to the base rectangularly to said first edge 20 by means of pairs of parallel rods 39*a*, 39*b* in the direction of the edges 21 and 22 of the base. There are typically two of said rod pairs 39*a*, 39*b*, one thereof being preferably placed on one edge 21 of the base and the other on the opposite edge 22 of the base, and the rods of each rod pair have been articulated 49 at one end to the transverse part 15 and at the other end, to the base 2 so that the rods 39*a* and 39*b* are mutually parallel while the loading surface 6 of the transverse part and the loading surface 4 of the base 2 are roughly paralleling. The articulated mountings 49 of the rods 39*a*, 39*b* onto the base 2 and onto the transverse part 15 are such that rotation around the axial lines parallel to the first edge 20 is possible. Hereby, the transverse part 15 can by the aid of a parallel transfer mechanism provided by the rods be moved outwards in direction D1 to form a continuation to base 2 or to an extension, whereby the loading surfaces 4, 6 of the base and the transverse part 15 are substantially in the same plane, as shown in FIG. 9 with broken line. When the transverse part 15 is moved inwards in direction D2 it can be taken into a recess in the base 2 (not shown) or onto the loading surface 4 of the base, whereby in the first instance (=enlarged loading surface area A1) the upper surface 8 of the transport pallet is substantially the same as the loading surface 4 of the base, and in the latter instance (=reduced loading surface area A1+A2), the upper surface 8 is at most by the thickness T2 of the transverse part 15 above the loading surface 4 of the base. However, since the thickness T2 of the transverse part is relatively small, the structure of said transport pallet 1 is also useful for most usages, such as for transportation of cars. The transverse part 15 must with a mechanism be locked in the position as an extension to the base 2. Said locking members can be supports 48 facing the undersurface 9 of the pallet, locking pins or equivalent members in the direction of the plane of the pallet plane, installed between the base and the transverse part (not shown).

FIGS. 7A, 7B, resp. 8A, 8B, present two slightly different embodiments, of the type whereof several similar ones can be modified. In the present one, the extension pieces 3 comprise a turnplate 13 on at least one edge of the base 2, hinged on said first edge 20, or two turnplates 14, possibly more. The pivot axis line 28 of said hinging 27 is in any case in the direction of said first edge 20, whereby the position of the turnplate moved out in direction D1 and widening the loading surface area A1+A2 consists of a turnplate 13 or turnplates 14 turned into extension to the loading surface 4 of the base, as depicted by the intact line in the figures. Hereby, the surface 6 constituting the other side of the turnplate or plates 13, 14 forms a loading surface being essentially extension to the loading surface 4 of the base, and approximately on the same height. After the turnplate 13 or turnplate 14 forming the extension pieces 3 is inserted in direction D2 into a portion reducing the loading surface area by turning it around the pivot axis line 28, the turnplate 13 or turnplates 14 enter the loading surface area. A1 of the pallet 2 in upside turned position, whereby the surface 7 opposite to the turnplates 13, 14 is settled approximately on the same height as the loading surface 4 of the base, thus providing part of the loading surface. The opposite loading surface 7 of the turnplate 13 or turnplates 14 is in the present instance made to match better with the loading surface 4 of the base by using thickenings 54 shown in FIG. 8A, the area whereof being at least somewhat smaller than the surface area of the extension piece, and said thickenings fitting in the equivalent recesses 19 in the base. Therefore, the thickenings, the thickness thereof being T2", are positioned at a point of the base in which the thickness is T1", and the thinner part of the turnplate, with thickness T2', enters a thicker point in the base, the thickness thereof being T1', whereby the upper surface of the transport pallet is at about point T1'+T2'=T1"+T2", so that the distance between the upper surface 8 and the undersurface 9 of the transport pallet is maximally only slightly greater than the thickness T1 of the base, as described above in the present application. Therefore, also the other loading surface 7 of the turnplate is substantially on the same height as the loading surface 4 of the base, or approaching it. Even if the difference were slightly greater, thus corresponding to the thickness T2 of the turnplate 13, as shown in FIG. 7A, also said structure is appropriate for a wide variety of different products, as for instance for transporting cars. It is obvious that the thicker points 54 of the extension pieces 3, the thickness thereof being T2", can be placed on the turnplate 13 or turnplates 14 in a number of ways, and the respective recesses 19 of the base 2 equivalent thereto can be formulated and positioned conforming to said thicknesses. Thus, the numerical value of the distance between the upper and undersurfaces of a transport pallet is in practice made to approach sufficiently the thickness dimension T1 of the base, i.e. to be a constant and independent of the positions of the extension pieces. Preferred can be, for instance, ridges in rectangular position to the first edge 20, in which case the rigidity of the turnplate is maintained good and it is easy to make recesses in parallel therewith in the base for said plates. The formulation and the mutual ratio between the loading surfaces are also affected by the location of the axial line 28 in the thickness direction T1 of the base. In the embodiment of the figures the axial line 28 is close to the loading surface 4, but it may also be arranged closer to the opposite surface 9.

FIGS. 10 and 11 show two alternatives of different types in which the extension pieces 3 comprise turnpieces 16 or 17 on at least one edge of the base, hinged on said first edge 20. The pivot axial lines 29*a*, resp. 29*b*, of said hinges 24*a* and 24*b* are in this case at right angles to said first edge 20, and to be more exact, also at right angles to the loading level 4 of the base. In the embodiment of FIG. 10, an opposed pair of partially overlapping quarter-circle shaped turnpieces 16 are provided. Each turnpiece is pivotally attached adjacent the corner thereof by a respective hinge 24*a* to a respective one of the opposite corners 30 of the base formed by the intersection of the first edge 20 and the edges 21, 22. The axial lines 29*a* of hinges 24*a* extend perpendicular to the base. In the embodiment of FIG. 11, a pair of rectangular turnpieces 17 are pivotally attached to the respective corners 30 of the base by hinges 24*b*. The axial lines 29*b* of the hinges 24*b* extend along the first side 20 of the base. Hereby, the turnpieces 16 and 17 can be moved outwards direction D1 by rotating them around the turnpieces 16 and 17 until the turnpieces form an extension to the base, as depicted with intact lines in FIGS. 10 and 11. The turnpieces 16 and 17 are reinserted by rotating them in reverse direction D2, whereby the loading surface area is at minimum, when said turnpieces 16 and 17 are within the loading surface area A1 of the base, as depicted in dotted lines in FIGS. 10 and 11. As such, the turnpieces 16 and 17 can be located at the thickness T1 of the base 2, and by the dimension of the thickness, whereby they must be thinner than the base so that they can preferably be accomodated within the area of the base between the loading surface 4 of the base and the undersurface 9 thereof. For said purpose, a slit can be provided in the base inwards from the edge 20 of the base, a recess on the top surface or a recess on the undersurface, indicated with reference numeral 51 in the figure. The advantage of the embodiment in which the turnpieces 16 penetrate when being inserted D2 in FIG. 10 into the base 2 is that the surface plates of the base at that moment on both sides of the inwards turned extension pieces or equivalent support the turnpieces against the bending brought about by the loading force of load K directed thereat. With the solution according to FIG. 10 also an advantage is gained that the loading surface area A1+A2 therein can at least to some extent be adjusted steplessly, depending on the extent in which the pieces are turned outwards in direction D1. The actual structural difference between the designs shown in FIG. 10 and in FIG. 11 lies only therein that in the instance of FIG. 10 the turnpiece 16 is turned to the inserted position D2 and back to the extracted position D1 across the first edge 20 associated thereto in direction 41. In the instance shown in FIG. 11, the turnpieces 17 are turned to the inserted position D2 and back to the extracted position D1 outside the opposite edges 21 and 22 in rectangular position to said first edge in direction 40. In the instance shown both in FIG. 10 and FIG. 11, it is also conceivable that by means of the turnpiece 16 and 17 the loading surface area can be enlarged, in addition of the first edge outwards, as shown in the figures, also alternatively outwards from the perpendicular edges 21 and 22 against said edge. For instance, in the case shown in FIG. 11 this would take place in that the turnpieces 17 are kept in the position in which they are in approximate alignment to the first edge 20 and perpendicular to the edges 21 and 22, at right angle relative to the positions illus-trated with an intact and a dotted line now presented in the figure. Similarly, in the instance of FIG. 10 the turn-pieces 16 can be turned either way to the position in which they are, when viewed from the base, beyond the edges 21 and 22.

FIG. 4 shows in detail a simple way of locking the extension pieces 3, and in FIG. 7A and 8A and 8B, an application of the same principle in another mechanism. The locking means 36 used with the response channels 26 and the rails 25 for locking the extension pieces 10, 11 into any position desired, comprises, for instance, in the rails 25, or at least in one of the rails 25 the rows of holes 35*a*, as shown in FIG. 3B. In addition, the base is provided with one or more holes 35*b* in the response channels 6 at the equivalent point, wherethrough a locking bolt or locking bolts 34 can be inserted into the holes 35*a* of the rails 25, as illustrated in FIG. 4. This prevents displacement of the extension piece 3 in both directions D1 and D2. In addition, FIG. 4 presents the positioning of an auxiliary piece for the locking bolt 34, or the positioning thereof during the transfer of the extension piece 3 with a reference numeral in the brackets. Said locking means 31 has been so applied for rotatable hinging that the locking bolt 34 is inserted through the sleeve part 32 of the hinges, resp. the locking holes through the pin part 33. In the above instance, the sleeve part corresponds to the base and the pin to the rail. Also other, different locking mechanisms are simple to develop.

As taught by the invention, the internal structure of one base of the pallet and of the extension pieces 10 to 17 can in itself be of any type to be appropriate for use in any application, such as a sandwich structure. Such laminated structure known in itself in the art may for instance be used which is disclosed in U.S. Pat. No. 3,622,114 but which structure said patent does not, however, concern, or a cell plate comprising an internal part of cell structure and a surface plate, disclosed in publication U.S. Pat. No. 3,709,161, or equivalent cell plate known in itself in the art. It is also possible to use a metal plate provided with lightening perforations, such as aluminium plate, like the one shown in FIGS. 3A, 3B and 4, whereby the lightening perforations are marked with reference numeral 38. Also laminated and sandwich structures disclosed in publications U.S. Pat. No. 4,801,483 or GB-2,182,703 can be used, or other structures known in themselves in the art. With said structures, the pallet can be made relatively thin and light in weight, still, carrying a load well. Typically, the greatest thickness T1 and T2 of both the base and the extensions is of the order of magnitude 30 to 80 mm when the pallet is used for transporting e.g. cars or equivalent unit goods K with a weight of 5000 kg at most, and when the pallet is moved on roller tracks or equivalent. If the distances between the rollers of said roller tracks is very small, e.g. of the order of magnitude 30 cm, a considerably thinner pallet can be used, the thickness T1, T2 thereof can, when lowest, thus be only 5 to 6 mm. The maximum length LL of the transport pallet 1 in the extracted position of the extension pieces is preferably equal to the length of a 20 feet, i.e. 6.1 meter, container in said target. Normally, the pallets need not withstand e.g. without bending such loading when the pallet is merely at the ends or otherwise supported. As regards potential special requirements, the general goods loads 15,000 to 20,000 kg corresponding to the payload capacity of the containers, and the requirement concerning liftability e.g. at the corners, the base of a pallet and the extension piece have to be made thicker to comply with the strength and rigidity requirements set in each instance. On the other hand, if the purpose is to transport smaller general cargo and/or lighter general cargo K, the size and thickness of the base and the extension piece can be reduced from those presented above. When cars are particularly regarded as the unit cargo K, the transfer margin of the extension pieces 3 must be such that transferring them from the in-position to the out-position, and back, changes the length LL of the transport pallet by at least 1 meter, preferably by at least 1.5 meter. In practice, with said transfer margin, all passenger cars and most of the vans can be made to be accomodated on a transport pallet. There are no obstacles against increasing the transfer margin, even to be considerably greater. For instance, when the length L2 of the base is about half of the length of a 20 feet container, i.e. 3.0 to 3.1 meter, the transfer margin can be of equal length, i.e. about 3 m, whereby the total length LL of the transport pallet is at most equivalent to the length of a 20 feet container, that is, about 6.1 m. The pallet of the invention may also be made thinner locally, as shown in FIGS. 1 and 3A, 3B and 8A, with the purpose of making it lighter, but, however, to provide a sufficient structural thickness at the rails. At the point of thinning, the loading surface area is indicated by 4", the thickness T1" at that point being said 5 to 6 mm when the thickness T1' at the edges can be said 30 to 80 mm.

The invention is not confined to the above-described embodiments, and it may be varied within the scope defined by the accompanying claims.

I claim:

1. A pallet for transporting cargo, comprising:

a rectangular base having fixed dimensions and having a base loading surface, a thickness defined perpendicular to the base loading surface, a first edge, an opposite second edge and a pair of opposite base edges extending between the first and second edges, the loading surface being capable of supporting cargo thereupon;

an extension member adjustably attached to the base adjacent the first edge for selective extension from the base between a retracted position and an extended position, the extension member having an extension loading surface and an extension thickness defined substantially perpendicular to the extension loading surface, the extension loading surface being substantially co-planar with the base loading surface in the retracted position and the extended position;

rails extending from one of said base and said extension member and the other of said base and said extension member having channels defined therein to slidably receive said rails, such that said extension member is slidably extendable from said base to form a selectively variable total loading surface; and a plate fixedly attached to the extension member and extending toward the base, the plate sliding along the loading surface of the base when the extension member slides between the retracted and extended positions, said plate providing a substantially continuous total support surface from the base to the extension member in a range of positions of the extension member relative to the base.

2. The pallet of claim 1, wherein the rails have a length, and the plate has a length dimension extending from the extension member that is at least as long as the length of the rails.

3. The pallet of claim 1, wherein the plate has opposing plate edges extending along the opposite base edges, the opposing plate edges angled and slidably received within grooves defined in the base, the angled plate edges increasing the rigidity of the plate.

4. The pallet of claim 1, further comprising a locking device attachable to the pallet to lock the extension member in selected positions relative to the base.

5. The pallet of claim 4 wherein the locking device includes locking bolts received in apertures formed in the pallet adjacent the base and the extension member to lock the extension member in selected positions relative to the base.

6. The pallet of claim 1, wherein the base has a length of approximately ten feet, and the extension member in the extended position extends the length by at least one meter.

7. The pallet of claim 1, wherein the base has a length of approximately ten feet, and the extension member in the extended position extends the length by at least one and one-half meters.

8. The pallet of claim 1, wherein the base has a length of approximately ten feet, and the extension member in the extended position establishes an overall length for the pallet of about twenty feet.

9. The pallet of claim 1, wherein the base and the extension member are comprised of an internal structure selected from the group consisting of a laminated structure, a cell plate having an internal part of cell structure and a surface plate, and a perforated metal plate, the extension member and base each have a maximum thickness of about 30 to 80 millimeters.

10. A pallet for transporting cargo, comprising:

a rectangular base having fixed dimensions and having a base loading surface, a thickness defined perpendicular to the base loading surface, a first edge, an opposite second edge and a pair of opposite base edges extending between the first and second edges, the loading surface being capable of supporting cargo thereupon;

an extension member adjustably attached to the base adjacent the first edge for selective extension from the base between a retracted position and an extended position, the extension member having an external loading surface and an extension thickness defined substantially perpendicular to the extension loading surface, the extension loading surface being substantially co-planar with the base loading surface in the retracted position and the extended position; and wherein the extension member is attached to the base by parallel opposing pairs of pivotable elongate connecting elements, the connecting elements each having a first end pivotally attached to the base adjacent one of the opposite base edges, the connecting elements each having a second end pivotally attached to the extension member, the connecting elements pivotal relative to both the base and the extension member about axes parallel to the first edge to move the extension member from the retracted position to the extended position.

11. The pallet of claim 10, further comprising a locking device attachable to the pallet to lock the extension member in selected positions relative to the base.

12. The pallet of claim 11, wherein the locking device includes locking pins received in apertures formed in the pallet adjacent the connecting elements and the base and adjacent the connecting elements and the extension member to lock the extension member in selected positions relative to the base.

13. The pallet of claim 10, wherein the base and the extension member are comprised of an internal structure selected from the group consisting of a laminated structure, a cell plate having an internal part of cell structure and a surface plate, and a perforated metal plate, the extension member and base each have a maximum thickness of about 30 to 80 millimeters.

14. A pallet for transporting cargo, comprising:

a rectangular base having fixed dimensions and having a base loading surface, a thickness defined perpendicular to the base loading surface, a first edge, an opposite second edge and a pair of opposite base edges extending between the first and second edges, the loading surface being capable of supporting cargo thereupon;

an extension member adjustably attached to the base adjacent the first edge for selective extension from the base between a retracted position and an extended position, the extension member having an extension loading surface and an extension thickness defined substantially perpendicular to the extension loading surface, the extension loading surface being substantially co-planar with the base loading surface in the retracted position and the extended position;

wherein the extension member has a member end edge facing away from the base in the extended position of the extension member, and a cantilever member is adjustably mounted adjacent at least one of the second edge of the base and the extension member end edge for selective extension of the cantilever member from the member on which it is mounted between a retracted position and an extended position, and in which extended position it extends from the respective edge in the lengthwise direction of the pallet to limit the approach of foreign objects in a direction lengthwise of the pallet.

15. The pallet of claim 14, further comprising a locking device attachable to the pallet to lock the extension member in selected positions relative to the base.

16. The pallet of claim 15, wherein the locking device includes locking bolts received in apertures formed in the pallet adjacent the base and the extension member to lock the extension member in selected positions relative to the base.

17. The pallet of claim 14, wherein the base and the extension member are comprised of an internal structure selected from the group consisting of a laminated structure, a cell plate having an internal part of cell structure and a surface plate, and a perforated metal plate, the extension member and base each have a maximum thickness of about 30 to 80 millimeters.

18. A method of positioning upon a cargo pallet a vehicle having a first and second pairs of coaxial wheels, comprising the steps of:

providing a pallet base having a base loading surface, a first edge, an opposite second edge and a pair of opposing base edges extending transverse to the first and second edges, and an extension member having an extension loading surface, the extension member being adjustably attached to the base adjacent to the first edge for selective extension from the base between a retracted position and an extended position;

positioning the vehicle on the pallet with the first pair of wheels upon the base loading surface;

extending the extension member such that the extension loading surface is substantially co-planar with the base loading surface;

positioning the second pair of wheels upon the extension loading surface;

providing an extendable cantilever member on at least one of the base and the extension member for selective extension between a retracted position and an extended position from the base or the extension member on which it is mounted; and extending the cantilever member such that the base, extension member and cantilever member establish an overall pallet length that is at least as great as the length of the vehicle supported on said pallet.

* * * * *